US008307656B2

(12) United States Patent
Tuthill

(10) Patent No.: US 8,307,656 B2
(45) **Date of Patent: *Nov. 13, 2012**

(54) GAS TURBINE ENGINE SYSTEMS INVOLVING COOLING OF COMBUSTION SECTION LINERS

(75) Inventor: Richard S. Tuthill, Bolton, CT (US)

(73) Assignee: United Technologies Corp., Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/287,619

(22) Filed: Nov. 2, 2011

(65) Prior Publication Data

US 2012/0102960 A1 May 3, 2012

Related U.S. Application Data

(62) Division of application No. 11/937,586, filed on Nov. 9, 2007, now Pat. No. 8,051,663.

(51) Int. Cl.
*F02G 3/00* (2006.01)

(52) U.S. Cl. ..... 60/755; 60/752

(58) Field of Classification Search ..... 60/39.37, 60/752–760, 800

See application file for complete search history.

(56) References Cited

U.S. PATENT DOCUMENTS

| | | | |
|---|---|---|---|
| 3,759,038 | A | 9/1973 | Scalzo et al. |
| 4,566,280 | A | 1/1986 | Burr |
| 4,668,164 | A | 5/1987 | Neal et al. |
| 4,719,748 | A | 1/1988 | Davis et al. |
| 4,720,236 | A | 1/1988 | Stevens |
| 4,747,542 | A | 5/1988 | Cires et al. |
| 4,901,522 | A | 2/1990 | Commaret et al. |
| 5,143,292 | A | 9/1992 | Corsmeier et al. |
| 5,239,831 | A | 8/1993 | Kuroda et al. |
| 5,460,002 | A | 10/1995 | Correa |
| 5,461,866 | A | 10/1995 | Sullivan et al. |
| 5,560,198 | A | 10/1996 | Brewer et al. |
| 5,784,876 | A | 7/1998 | Alkabie |

(Continued)

FOREIGN PATENT DOCUMENTS

| | | |
|---|---|---|
| GB | 2306594 | 5/1997 |

(Continued)

OTHER PUBLICATIONS

EP Search Report for EP2058475 dated Mar. 5, 2012.

*Primary Examiner* — Phutthiwat Wongwian
(74) *Attorney, Agent, or Firm* — O'Shea Getz P.C.

(57) ABSTRACT

Gas turbine engine systems involving cooling of combustion section liners are provided. A representative liner includes: an outer side, an inner side, an upstream end, and a downstream end, the outer side being configured to face away from a combustion reaction, the inner side being configured to face the combustion reaction; a cooling air channel, a portion of the cooling air channel being located proximate the downstream end; and cooling holes formed through the inner side of the liner, the cooling holes being in fluid communication with the cooling air channel such that cooling air provided to the cooling air channel is directed through the cooling holes and to the inner side of the liner such that at least a portion of the inner side of the liner receives cooling air despite a corresponding portion located on the outer side of the liner being obstructed from receiving cooling air.

5 Claims, 2 Drawing Sheets

U.S. PATENT DOCUMENTS

| | | | |
|---|---|---|---|
| 5,987,879 | A | 11/1999 | Ono |
| 6,334,310 | B1 | 1/2002 | Sutcu et al. |
| 6,658,853 | B2 | 12/2003 | Matsuda et al. |
| 6,869,082 | B2 | 3/2005 | Parker |
| 7,007,482 | B2 | 3/2006 | Green et al. |
| 7,096,668 | B2 | 8/2006 | Martling et al. |
| 7,269,957 | B2 | 9/2007 | Martling et al. |
| 7,284,378 | B2 | 10/2007 | Amond et al. |
| 7,524,167 | B2 | 4/2009 | Ohri et al. |
| 2005/0132708 | A1 | 6/2005 | Martling et al. |
| 2005/0262844 | A1 | 12/2005 | Green et al. |
| 2005/0262845 | A1 | 12/2005 | Martling et al. |
| 2009/0282833 | A1 | 11/2009 | Hessler et al. |
| 2010/0229564 | A1 | 9/2010 | Chila |

FOREIGN PATENT DOCUMENTS

| | | |
|---|---|---|
| JP | 8285284 | 1/1996 |
| JP | 8270947 | 10/1996 |
| JP | 2002071136 | 3/2002 |

GAS TURBINE ENGINE SYSTEMS INVOLVING COOLING OF COMBUSTION SECTION LINERS

PRIORITY INFORMATION

This application is a divisional of U.S. patent application Ser. No. 11/937,586 filed Nov. 9, 2007.

BACKGROUND

1. Technical Field

The disclosure generally relates to gas turbine engines.

2. Description of the Related Art

Combustion sections of gas turbine engines are used to contain combustion reactions that result from metered combinations of fuel and air. Such a combustion reaction is a high temperature process that can damage components of a gas turbine engine if adequate cooling is not provided.

In this regard, various combustion section components are adapted to perform in high temperature environments. These components are cooled in a variety of manners. By way of example, impingement cooling can be used that involves directing of cooling air against the back surface of a component that faces away from the combustion reaction.

SUMMARY

Gas turbine engine systems involving cooling of combustion liners are provided. In this regard, an exemplary embodiment of a gas turbine engine comprises: a compressor; a turbine operative to rotate the compressor; and a combustion section operative to provide thermal energy for rotating the turbine; the combustion section comprising: a transition piece having an open, upstream end; a liner having an outer side, an inner side, an upstream end and a downstream end, the outer side being configured to face away from a combustion reaction of the combustion section, the inner side being configured to face the combustion reaction, and the downstream end being received within the open, upstream end of the transition piece such that gas associated with the combustion reaction is directed from the liner, through the transition piece and to the turbine; and a cooling air channel located at the outer side of the liner, the cooling air channel being operative to direct cooling air from the outer side of the liner to the inner side of the liner to cool a portion of the downstream end of the liner obstructed by the transition piece.

An exemplary embodiment of a combustion section of a gas turbine engine comprises: a transition piece having an upstream end; a liner having an outer side, an inner side and a downstream end, the outer side being configured to face away from a combustion reaction of the combustion section, the inner side being configured to face the combustion reaction, and the downstream end being sized and shaped to be received within the upstream end of the transition piece; a cooling air channel, at least a portion of the cooling air channel being located in a vicinity of the downstream end of the liner such that, when the downstream end is inserted into the transition piece, a first portion of the cooling air channel is located within the transition piece and a second portion of the cooling air channel is located outside the transition piece; and cooling holes formed through the inner side of the liner, the cooling holes being in fluid communication with the cooling air channel such that cooling air provided to the cooling air channel is directed into the transition piece, through the cooling holes and to the inner side of the liner such that at least a portion of the liner obstructed by the transition piece receives cooling air.

An exemplary embodiment of a combustion liner for a combustion section of a gas turbine engine comprises: an outer side, an inner side, an upstream end and a downstream end, the outer side being configured to face away from a combustion reaction, the inner side being configured to face the combustion reaction; a cooling air channel, at least a portion of the cooling air channel being located in a vicinity of the downstream end; and cooling holes formed through the inner side of the liner, the cooling holes being in fluid communication with the cooling air channel such that cooling air provided to the cooling air channel is directed through the cooling holes and to the inner side of the liner such that at least a portion of the inner side of the liner receives cooling air despite a corresponding portion located on the outer side of the liner being obstructed from directly receiving cooling air.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engine systems involving cooling of combustion liners are provided. As will be described in detail below, several embodiments incorporate the use of effusion holes that are used to direct cooling air from the side of the combustion liner facing away from the combustion reaction to the side of the liner facing the combustion reaction. Notably, the effusion holes are located at portions of the liners that typically are obstructed from receiving cooling airflow from convection and/or impingement cooling provisions. In some of these embodiments, cooling airflow is directed to the effusion holes by channels formed in the sides of the liners that face away from the combustion reaction.

Figure 1:
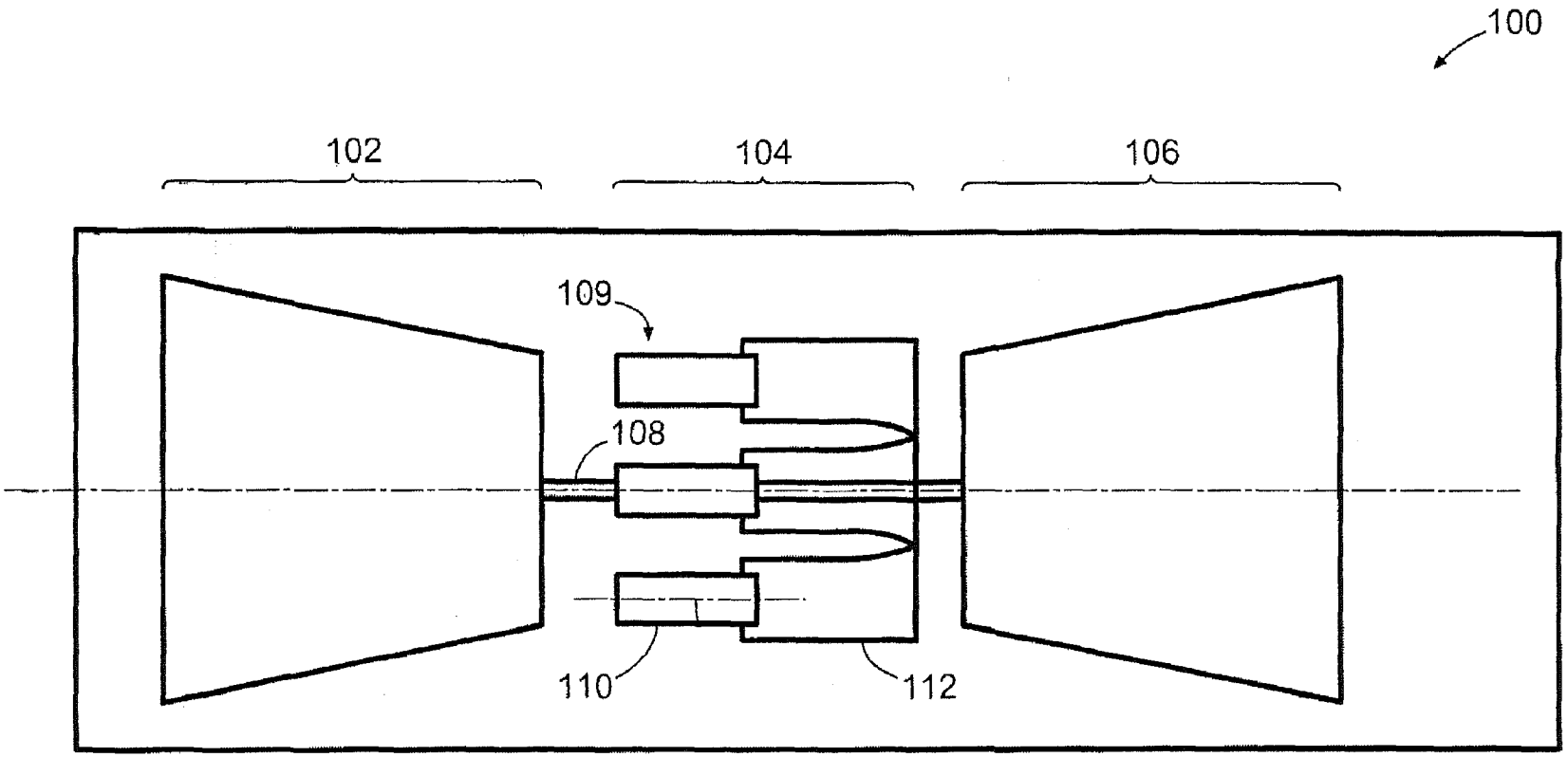
FIG. 1 is a schematic diagram depicting an embodiment of a gas turbine engine.

Referring now in greater detail to the drawings, FIG. 1 is a schematic diagram depicting an embodiment of a gas turbine engine. As shown in FIG. 1, engine 100 is an industrial gas turbine engine (e.g., land-based or ship-borne) that incorporates a compressor section 102, a combustion section 104, and a turbine section 106. The turbine section powers a shaft 108 that drives the compressor section. It should also be noted that although engine 100 is configured as an industrial gas turbine, the concepts described herein are not limited to use with such configurations.

Combustion section 104 includes an annular arrangement 109 of multiple combustion liners (e.g., liner 110) in which combustion reactions are initiated. The liners are engaged at their downstream ends by transition pieces (e.g., transition piece 112). In this embodiment, each of the transition pieces receives a corresponding downstream end of a liner, which is most often cylindrical. The transition pieces direct the flows of gas and combustion products (indicated as arrow 130 in FIG. 2) from the liners to the annular-shaped entrance of the turbine section.

Figure 2:
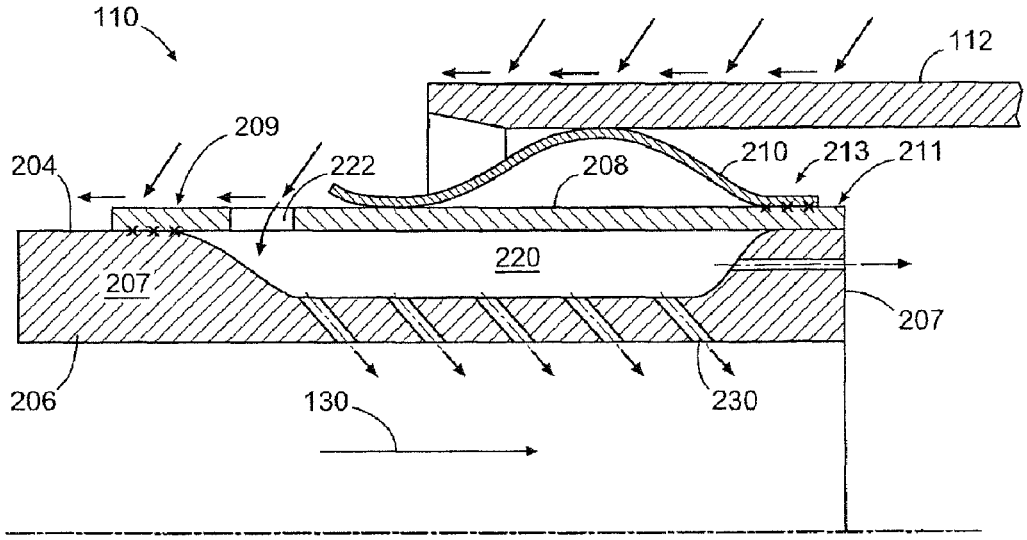
FIG. 2 is a partially cutaway, cross-sectional schematic view depicting an embodiment of a combustion section liner engaging a transition piece.

A portion of liner 110 and transition piece 112 is depicted schematically in FIG. 2. As shown in FIG. 2, liner 110 includes a hot or inner side 206 (oriented to face a combustion reaction), a cool or outer side 204 (oriented to face away from the combustion reaction), and endwalls (e.g., endwall 207 located at the downstream end of the liner). Liner 110 also includes a baffle wall 208 (also referred to as a "barrier wall"), which contacts the outer side of the liner at an attachment location. In the embodiment of FIG. 2, an upstream portion 209 of the baffle wall is attached (e.g., welded) to the outer side 204 as indicated by the X's.

A seal 210, in this case a hula seal, is attached to the baffle wall. The hula seal provides a physical barrier between the baffle wall and transition piece 112 for preventing gas leakage. In the embodiment of FIG. 2, a downstream portion 211 of the baffle wall is welded to a downstream portion 213 of the hula seal as indicated, but in other embodiments could be oriented in the opposite direction and attached to the upstream portion.

Liner 110 also incorporates a cooling air channel 220 located inboard of the baffle wall. Notably, the upstream end of the transition piece 112 could obstruct a flow of cooling air (indicated by the arrows) that is directed toward the outer side of the liner. Specifically, the upstream end of the transition piece into which the downstream end of the liner is inserted can prevent cooling air from cooling the liner in a vicinity of the seal 210. However, cooling air provided to the liner in the vicinity of the seal is able to flow into the cooling channel via an aperture 222 formed in the barrier wall. From the cooling air channel, cooling air is directed through holes (e.g., hole 230) extending from the cooling air channel to the hot inner side 206 of the liner. Thus, the obstructed portion of the liner receives a flow of cooling air.

In some embodiments, at least some of the holes formed in the liner for directing cooling air to the hot side are effusion holes, i.e., holes that provide for the effusion of gas therethrough. As such, the holes may be formed by a variety of techniques including drilling holes through the liner and/or providing the liner with engineered porosity, for example. Notably, holes can optionally be formed between the cooling air channel and an end wall (as in the embodiment of FIG. 2) and/or between the cooling air channel and the inner side.

Figure 3:
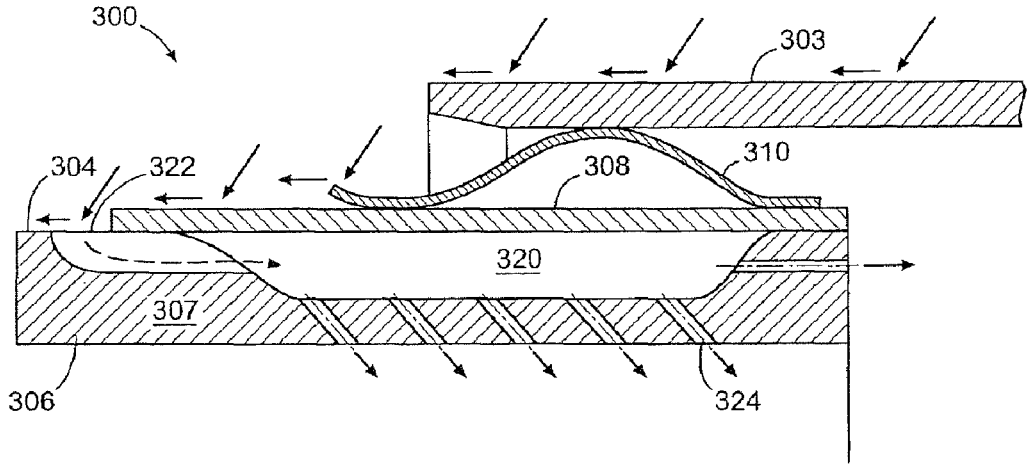
FIG. 3 is a partially cutaway, cross-sectional schematic view depicting another embodiment of a combustion section liner engaging a transition piece.

A portion of another embodiment of a liner and a transition piece is depicted schematically in FIG. 3. As shown in FIG. 3, liner 300 engages a transition piece 303. Liner 300 includes a hot or inner side 306 (oriented to face a combustion reaction), a cool or outer side 304 (oriented to face away from the combustion reaction), and endwalls (e.g., endwall 307 located at the downstream end of the liner). A baffle wall 308 is attached to the outer side of the liner. Additionally, a seal 310, in this case a hula seal, is attached to the baffle wall.

Liner 300 also incorporates a cooling air channel 320 located inboard of the baffle wall. In contrast to the embodiment of FIG. 2, baffle wall 308 does not include an aperture, although one or more apertures could be provided in other embodiments. In this regard, cooling air is provided to the cooling air channel 320 via a passageway 322 that is formed in the outer side of the liner 300. In this embodiment, the passageway is configured as a slot (one of a plurality of such slots that are annularly arranged about the liner). The passageway 322 enables the liner to provide adequate structural support for supporting the baffle wall while enabling cooling air to flow underneath an end of the baffle wall. Thus, cooling air can enter the cooling air channel 320 via the passageway 322 and then be directed through holes (e.g., hole 324) extending from the cooling air channel to the inner side of the liner.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A gas turbine engine comprising:

a compressor;

a turbine operative to rotate the compressor; and a combustion section operative to provide thermal energy for rotating the turbine;

the combustion section comprising:

a transition piece having an open, upstream end;

a liner having an outer side, an inner side, an upstream end and a downstream end, the outer side being configured to face away from a combustion reaction of the combustion section, the inner side being configured to face the combustion reaction, and the downstream end being received within the open, upstream end of the transition piece such that gas associated with the combustion reaction is directed from the liner, through the transition piece and to the turbine; and a cooling air channel located at the outer side of the liner, the cooling air channel being operative to direct cooling air from the outer side of the liner to the inner side of the liner to cool a portion of the downstream end of the liner obstructed by the transition piece;

a barrier wall attached to the outer side of the liner; and a cooling slot formed in the outer side of the liner and in fluid communication with the cooling air channel, the cooling slot extending between at least a portion of the barrier wall and the inner side of the liner.

2. The gas turbine engine of claim 1, wherein the barrier wall has an aperture formed therein such that cooling air directed toward the barrier wall is provided to the cooling air channel via the aperture of the barrier wall.

3. A combustion section of a gas turbine engine comprising:

a transition piece having an upstream end;

a liner having an outer side, an inner side and a downstream end, the outer side being configured to face away from a combustion reaction of the combustion section, the inner side being configured to face the combustion reaction, and the downstream end being sized and shaped to be received within the upstream end of the transition piece;

a cooling air channel, at least a portion of the cooling air channel being located in a vicinity of the downstream end of the liner such that, when the downstream end is inserted into the transition piece, a first portion of the cooling air channel is located within the transition piece and a second portion of the cooling air channel is located outside the transition piece; and cooling holes formed through the inner side of the liner, the cooling holes being in fluid communication with the cooling air channel such that cooling air provided to the cooling air channel is directed into the transition piece, through the cooling holes and to the inner side of the liner such that at least a portion of the liner obstructed by the transition piece receives cooling air;

a barrier wall contacting the outer side of the liner, at least a portion of the barrier wall being located in a vicinity of the downstream end of the liner such that, when the downstream end is inserted into the transition piece, a first portion of the barrier wall is located within the transition piece and a second portion of the barrier wall is located outside the transition piece; and a cooling slot formed in the outer side of the liner and in fluid communication with the cooling air channel, the cooling slot extending between at least a portion of the barrier wall and the outer side of the liner.

4. The combustion section of claim 3, wherein the barrier wall has an aperture formed therein such that cooling air directed toward the barrier wall is provided to the cooling air channel via the aperture of the barrier wall.

5. A combustion liner for a combustion section of a gas turbine engine, the liner comprising:

an outer side, an inner side, an upstream end and a downstream end for being received within a transition piece, the outer side being configured to face away from a combustion reaction, the inner side being configured to face the combustion reaction;

a cooling air channel formed in the outer side between the liner and a barrier wall, at least a portion of the cooling air channel being located in a vicinity of the downstream end;

cooling holes formed through the inner side of the liner, the cooling holes being in fluid communication with the cooling air channel such that cooling air provided to the cooling air channel is directed through the cooling holes and to the inner side of the liner such that at least a portion of the inner side of the liner receives cooling air despite a corresponding portion located on the outer side of the liner being obstructed from directly receiving cooling air; and a cooling slot formed in the outer side of the liner, the cooling slot being in fluid communication with the cooling air channel.

* * * * *